United States Patent [19]

Breed et al.

[11] 3,973,092

[45] Aug. 3, 1976

[54] ACCELERATION SENSING SWITCH OF THE LIQUID CONTACT TYPE HAVING TIME DELAY STRUCTURE

[75] Inventors: David S. Breed, Boonton; Harald S. Husby, Budd Lake; Stanley Sung, Boonton Township, all of N.J.

[73] Assignee: Breed Corporation, Fairfield, N.J.

[22] Filed: Mar. 22, 1974

[21] Appl. No.: 453,992

[52] U.S. Cl. ..... 200/61.47; 200/186; 200/221; 200/225; 200/228; 200/232

[51] Int. Cl.[2] ..... H01H 35/14; H01H 29/08

[58] Field of Search ..... 200/61.47, 182, 186, 200/187, 188, 189, 190, 208, 214, 220, 221, 224, 225, 228, 229, 231, 235, 232

[56] References Cited

UNITED STATES PATENTS

| | | | |
|---|---|---|---|
| 2,192,797 | 3/1940 | Muter | 200/221 X |
| 2,254,710 | 9/1941 | Reid | 200/186 X |
| 2,275,011 | 3/1942 | Erich | 200/61.47 |
| 2,302,050 | 11/1942 | Pearce | 200/225 X |
| 2,863,014 | 12/1958 | Deer et al. | 200/225 X |
| 2,870,280 | 1/1959 | Kraus | 200/186 X |

FOREIGN PATENTS OR APPLICATIONS

| | | | |
|---|---|---|---|
| 621,657 | 11/1935 | Germany | 200/225 |
| 557,095 | 11/1943 | United Kingdom | 200/221 |

*Primary Examiner*—James R. Scott

[57] ABSTRACT

Acceleration sensing apparatus comprises a casing having a pair of substantially perpendicular passages communicating with each other and accommodating spaced apart, normally open electrical contacts. One of the passages contains mercury which is operable to flow into the other passage in response to predetermined acceleration of the casing and bridge the conductors so as to establish a current path therebetween.

10 Claims, 6 Drawing Figures

ACCELERATION SENSING SWITCH OF THE LIQUID CONTACT TYPE HAVING TIME DELAY STRUCTURE

BACKGROUND OF THE INVENTION

This invention relates to acceleration sensing apparatus and more particularly to a sensor operable in response to a predetermined acceleration to energize an electrical circuit and permit apparatus such as a vehicle passenger restraint device to be actuated.

Vehicle manufacturers currently are concerned with the protection of vehicle occupants in the event the vehicle should be involved in a crash. One proposed protective device is an inflatable bag which, upon rapid deceleration of the vehicle, inflates quickly so as to restrain movement of the vehicle's occupants and protect them against injury. The inflation of the bag depends upon operation of an actuating mechanism triggered by the operation of a sensor which detects the deceleration of the vehicle. If the occupant restraining device is to be successful in operation, the vehicle must be equipped with several triggering sensors that are mounted at a number of different points on the vehicle and in such locations as to be operated very early in the progress of a crash. For example, a triggering sensor may be mounted on the front bumper of a vehicle so as to be operated by the deceleration of the bumper which may occur prior to appreciable deceleration of the vehicle's occupants. In such an arrangement, the restraining bag will be inflated in sufficient time to protect the occupant.

Although triggering sensors of the kind referred to are capable of functioning satisfactorily, care must be taken to prevent actuation of the restraining mechanism in which an occupant of a vehicle requires no protection. For example, a vehicle's bumper may be displaced at a sufficiently rapid rate of speed to operate the trigger sensor, but the displacement of the bumper could be absorbed in such manner that the passenger compartment of the vehicle would not be subjected to sufficient deceleration as to cause injury to its occupant. In addition, it is desirable that means be provided in conjunction with the restraint mechanism to prevent actuation thereof by vandals.

An object of this invention is to provide an acceleration sensing device for use in conjunction with one or more sensors which trigger operation of a vehicle's occupant restraining mechanism and which prevents operation of such mechanism except in those instances in which its operation is desired.

Another object of the invention is to provide an acceleration sensor of the kind referred to which may be mounted on a vehicle in or near the passenger compartment so as to be subjected to the same acceleration forces as the latter.

A further object of the invention is to provide an acceleration sensor which is of small size, of simple construction, and reliable in operation.

BRIEF DESCRIPTION OF THE DRAWINGS

Other objects and advantages of the invention will be pointed out specifically or will become apparent from the following description when it is considered in conjunction with the appended claims and the accompanying drawings, in which:

DESCRIPTION OF THE PREFERRED EMBODIMENT

Figure 1:
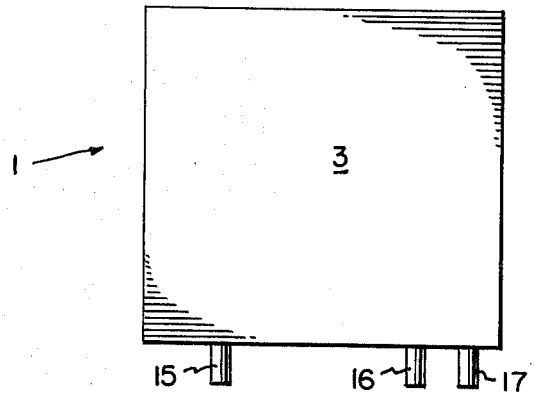
FIG. 1 is a side elevational view of a sensor constructed according to the invention.
Figure 2:
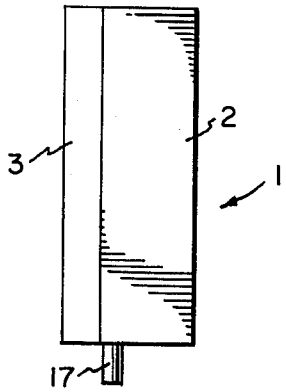
FIG. 2 is an end elevational view of the sensor.

Apparatus constructed according to the disclosed embodiment of the invention comprises a sensor 1 having a casing body 2 and a cover 3 which confronts and is secured to one side of the casing. The material from which the casing is formed may be any suitable non-conductive substance such as a ceramic or plastics. The cover may be secured to the body by ultrasonic welding or in any manner suitable for the material of which the casing is formed.

The cover 3 preferably is a flat member having smooth surfaces on its opposite sides. The body 2, however, is relieved at that side which confronts the cover so as to provide a pair of substantially right angle normal passages 4 and 5 which communicate with one another at substantially the right angle and at their confronting ends via a connecting passageway 6 having a tapered throat 7.

The body 2 also is relieved to provide a chamber 8 which communicates with one end of the passage 4 via a passageway 9. The chamber 8 also communicates with the opposite end of the passage 4 via a passageway 10 which is of less depth than the depth of either the passage 4 or the chamber 8. The chamber also communicates with the passage 5 via a passageway 11.

The body 2 is provided with a plurality of grooves 12, 13 and 14 for the accommodation of electrically conductive electrodes 15, 16, and 17, respectively. The electrode 15 has a bore 18, for a purpose to be described, and the conductors 16 and 17 are offset as at 19 and 20, respectively, to form extensions 21 and 22, respectively, that project into and are centered with respect to the passage 5. The confronting ends of the extensions 21 and 22 preferably are pointed.

The passage 4 has a preferably flat bottom 23 from which extends a number of upstanding obstruction baffles or fins 24 which span the width of the passage 4. Each fin has a height corresponding substantially to one half the height of the passage 4 and terminates in a flat upper surface 25. Each fin preferably has inclined front and rear sides 26 and 27, respectively, each side of each fin being inclined in the same direction but at a different angle. Thus, each front side 26 is inclined upwardly and toward the passage 5 at an angle of about 60° to the horizontal whereas each side 27 is inclined upwardly and toward the passage 5 at an angle of about 30° to the horizontal. The sides 26, therefore, are more abrupt than are the sides 27.

To assemble the sensor 1, the conductors 15, 16, and 17 are fitted into their respective grooves. Thereafter, the cover 3 is secured to the body 2. A quantity of a liquid conductor 28, such as mercury, then may be introduced to the passage 4 via the bore 18 of the conductor 15. Following the admission of the liquid to the passage 4, the bore 18 may be sealed by a suitable plug (not shown). The interior of the sensor also contains a quantity of gas, preferably hydrogen, which may be introduced to the sensor prior to the sealing of the bore 18.

The quantity of the conductive liquid introduced to the casing should be sufficient to enable the passage 4 to be completely filled when the casing is in an upright position and at rest. Preferably, there is sufficient liquid to enable the interconnecting passageway 6 to be filled partially. The quantity of the liquid should be insufficient, however, to occupy any part of the passage 5.

Figure 6:
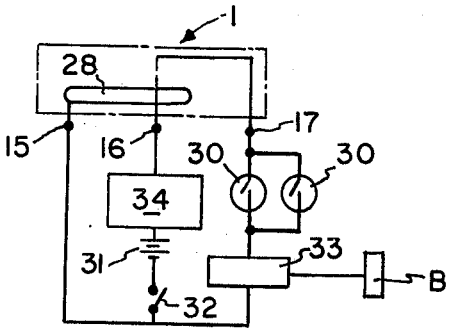
FIG. 6 is a simplified, schematic wiring diagram of a vehicle's passenger restraint mechanism incorporating a sensor constructed in accordance with the invention.

FIG. 6 discloses schematically an operating circuit for a typical vehicle passenger protective system and in which a sensor 1 according to the invention may be incorporated. In such a system a vehicle has an electrical circuit in which a plurality of normally open sensors 30 are connected in parallel and mounted at spaced positions on the vehicle. The sensors 30 are connected to a source of energy, such as a battery 31, via an ignition controlled switch 32 and an electrically operable actuating mechanism 33 of known construction which is operable to inflate a normally passive passenger restraining air bag B. The sensor 1 is connected via its conductors 15, 16, and 17, respectively, to the energy source 31, a diagnostic unit 34 of known construction, and to the circuit of the triggering sensors 30.

To condition the apparatus for operation the sensor 1 will be mounted within or adjacent the vehicle's passenger compartment in such manner that the passage 4 is substantially horizontal and extends longitudinally of the vehicle so that the passage 5 is toward the forward part of the vehicle and lies in a substantially vertical plane.

Upon closing of the ignition controlled switch 32 a circuit will be completed from the battery 31 to the conductor 15 and through the conductive liquid 28 and the conductor 16 to the diagnostic unit 34. As long as the vehicle is not subjected to a rearward acceleration an open circuit exists between the conductors 16 and 17, thereby precluding operation of the restraint actuating mechanism 33 even though one of the sensors 30 may be activated. Should the sensor 1 be subjected to a rearward acceleration of predetermined magnitude, the liquid conductor 28 will flow from the passage 4 into the passage 5 and bridge the gap between the conductors 16 and 17, thereby enabling a circuit to be completed from the battery 31 to the restraint actuator 33, provided one of the sensors 30 is closed.

In the construction of a sensing device according to the invention several important operating characteristics should be observed. First, the circuit between the conductors 15 and 16 should be interrupted before a circuit is completed between the conductors 16 and 17, and vice versus, so as to avoid a power drain through the diagnostic unit 34. Further, the circuit between the conductors 16 and 17 should be capable of being completed in response to a relatively low bias or acceleration force such as 0.7 G, thereby assuring circuit continuity to the actuator 33 upon closing of a sensor 30. In addition, a circuit must be maintained between the conductors 16 and 17 for a long enough period of time to assure circuit continuity to the actuator 33 even though a sensor 30 does not become operative until it is subjected to a considerably higher biasing force than is necessary to effect closing of the circuit between the conductors 16 and 17. Finally, the liquid conductor 28 must be capable of flowing without being retarded by unpredictable forces as those generated by the presence of gas in the sensor 1.

Figure 3:
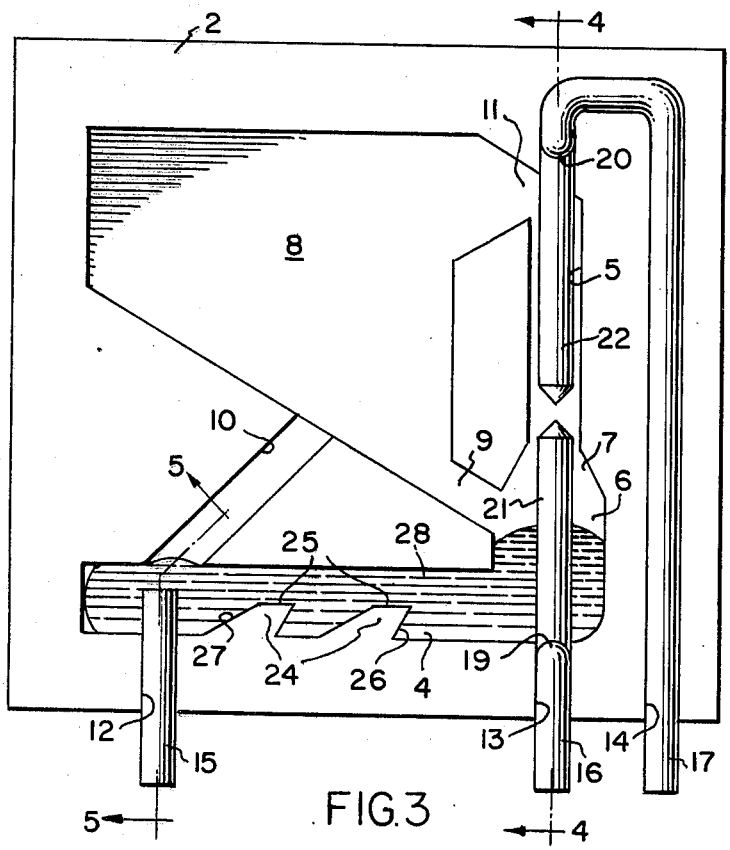
FIG. 3 is an enlarged, side elevational view of the sensor with its cover removed.
Figure 4:
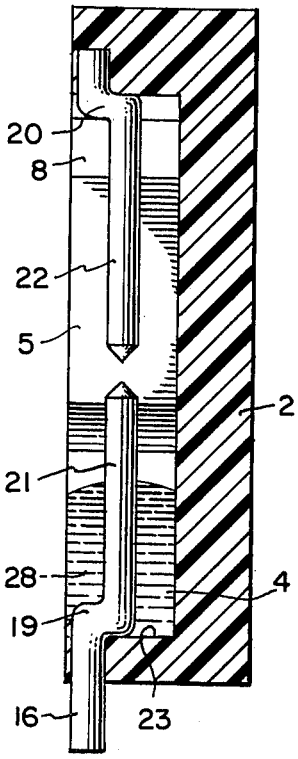
FIG. 4 is a cross-sectional view taken on the line 4—4 of FIG. 3.
Figure 5:
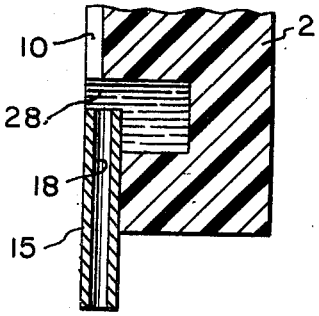
FIG. 5 is a sectional view taken on the line 5—5 of FIG. 3.

A sensing device constructed in accordance with the invention enables all of the foregoing characteristics to be realized. For example, if the sensor 1 is accelerated rearwardly or to the left, as viewed in FIGS. 1 and 3, the liquid conductor 28 will flow to the right from the passage 4 upwardly through the passageway 6 into the passage 5. The fins 24 do not exert an appreciable retardation on the flow of the liquid due to the low inclination of the surfaces 27. As the mercury enters the tapered throat 7, some resistance to its flow into the passage 5 will be encountered, thereby enabling a quantity of the liquid to enter the passageway 9, and enabling the liquid 28 to disengage the electrode 15. The liquid conductor 28 will enter the passage 5, however, so as to bridge the gap between the conductors 16 and 17. The cross-sectional area of the passage 5 is about 30% less than that of the passage 4 with the result that the mercury which enters the passage 5 will occupy a greater length of the latter than the same quantity of mercury would occupy in the passage 4. Thus, the gap between the electrodes 16 and 17 will be well covered so as to assure electrical continuity therebetween for the required period of time. In most instances, the passage 5 will be completely filled with mercury 28, but any excess will be able to flow through the passageway 11 into the compartment 8 for return to the interconnecting passage 6 via the passageway 9. The passageway 11 also prevents the accumulation of gas at the upper end of the passage 5, thereby avoiding retardation of the flow of mercury into the latter.

As the mercury flows from the passage 4 into the passage 5, gas may enter the rear end of the passage 4 via the passageway 10 so as to avoid the creation of suction at the rear end of the passage 4. The cross-sectional area of the passageway 10 is substantially less than that of the passage 4 so as to minimize the possibility that mercury will flow from the passage 4 into the passageway 10.

When the rearward acceleration of the casing 1 terminates, mercury in the pasage 5 will reenter the interconnecting passageway 6 and flow into the forward end of the passage 4. Gas may enter the passage 5 via the passageway 11 so as to prevent suction from retarding the flow of mercury from the passage. As the mercury flows rearwardly in the passage 4, the abrupt surfaces 26 of the fins 24 will exert a retarding force on the rearward movement of the mercury for a period of time sufficient to enable the gap between the conductors 16 and 17 to be uncovered or debridged before the mercury reengages the conductor 15. Gas in the passage 4 is exhausted therefrom via the passageway 10 into the chamber 8.

The particular biasing force that is sufficient to effect bridging of the conductors 16 and 17 is dependent upon several factors such as the dimensions of the passages 4 and 5, the length of the gap between the conductors 16 and 17 and the positioning thereof relative to one another, the quantity of mercury, and the like. These factors may be determined empirically.

The disclosed embodiment is representative of the presently preferred form of the invention, but is intended to be illustrative rather than definitive thereof. The invention is defined in the claims. We claim:

1. An acceleration sensing device comprising a casing having therein a pair of substantially normal passages forming substantially a right angle to one another and confronting one another at their adjacent ends; a first electrical conductor in one of said passages at one end of the latter; a second electrical conductor in the other of said passage confronting but spaced from said one electrical conductor; a quantity of electrically conductive liquid occupying said one of said passages and engaging said first conductor; and liquid passageway means establishing communication between said passages at said right angle, whereby acceleration of said casing in one direction enables a sufficient quantity of said liquid to flow from said one of said passages into the other of said passages and bridge said conductors to establish a conductive path therebetween.

2. A device according to claim 1 including another conductor in said one of said passages spaced from said first conductor, said first and said another conductors being bridged by said conductive liquid in the absence of acceleration of said casing.

3. A device according to claim 2 wherein the quantity of conductive liquid is less than that required to bridge said first and said another conductors when said liquid bridges said first and second conductors.

4. A device according to claim 3 wherein the quantity of conductive liquid is such that debridging of said one and said another conductors is effected prior to the bridging of said one and second conductors by said liquid.

5. A device according to claim 1 including obstruction means in said one of said passages for retarding return flow of said liquid from said other of said passages into said one of said passages.

6. A device according to claim 5 wherein said obstruction means comprises at least one fin extending into said one of said passages and occupying a position in the path of flow of said liquid.

7. A device according to claim 6 wherein said fin is inclined in the direction of flow of fluid from said one of said passages toward the other of said passages.

8. A device according to claim 1 including gas passage means separate from and communicating with both of said passages.

9. A device according to claim 1 including a chamber in said casing, and gas passage means separate from and establishing communication between said chamber and each of said passages.

10. A device according to claim 9 wherein said gas passage means establish communication between said chamber and both ends of each of said passages.

* * * * *